US011828493B2

(12) United States Patent
Porwal et al.

(10) Patent No.: US 11,828,493 B2
(45) Date of Patent: Nov. 28, 2023

(54) REAL-TIME HEATED WATER SUPPLY MEASUREMENT SYSTEMS FOR WATER HEATERS AND METHODS THERETO

(71) Applicant: Rheem Manufacturing Company, Atlanta, GA (US)

(72) Inventors: Piyush Porwal, Montgomery, AL (US); Ashwin Rao, Montgomery, AL (US); Nathan Rivard, Amelia, OH (US)

(73) Assignee: Rheem Manufacturing Company, Atlanta, GA (US)

( * ) Notice: Subject to any disclaimer, the term of this patent is extended or adjusted under 35 U.S.C. 154(b) by 0 days.

(21) Appl. No.: 17/712,308

(22) Filed: Apr. 4, 2022

(65) Prior Publication Data

US 2022/0221193 A1 Jul. 14, 2022

Related U.S. Application Data

(63) Continuation of application No. 15/931,838, filed on May 14, 2020, now Pat. No. 11,293,667.

(51) Int. Cl.

| | |
|---|---|
| ***F24D 19/10*** | (2006.01) |
| ***F24H 9/20*** | (2022.01) |
| ***F24H 1/08*** | (2022.01) |
| ***F24D 17/00*** | (2022.01) |
| ***F24H 1/18*** | (2022.01) |

(Continued)

(52) U.S. Cl.

CPC ..... *F24H 9/2007* (2013.01); *F24D 17/0031* (2013.01); *F24H 1/08* (2013.01); *F24H 1/18* (2013.01); *F24H 15/174* (2022.01); *F24H 15/225* (2022.01); *F24H 15/355* (2022.01); *F24H 15/395* (2022.01); *F24D 19/1051* (2013.01); *F24D 2220/042* (2013.01); *F24H 15/104* (2022.01); *F24H 15/12* (2022.01); *F24H 15/20* (2022.01); *F24H 15/215* (2022.01); *F24H 15/238* (2022.01); *F24H 15/242* (2022.01); *F24H 15/31* (2022.01); *F24H 15/421* (2022.01); *F24H 15/45* (2022.01); *F24H 15/486* (2022.01)

(58) Field of Classification Search

CPC ..... F24D 19/1006; F24D 2220/042; F24D 2240/20; F24D 2220/048; F24D 2240/22; F24D 2240/243; F24D 2240/26; F24H 9/2007

See application file for complete search history.

(56) References Cited

U.S. PATENT DOCUMENTS 8,176,881 B2 * 5/2012 Arensmeier ..... H04Q 9/00 709/224

10,330,344 B2 6/2019 Teng et al.

(Continued)

*Primary Examiner* — Gregory A Wilson

(74) *Attorney, Agent, or Firm* — Eversheds Sutherland (US) LLP

(57) ABSTRACT

Disclosed herein is a water heating system including a water heater having a tank, and a first temperature sensor disposed toward a top end of the tank to measure a first temperature and a second temperature sensor disposed toward a bottom end of the tank to measure a second temperature. The water heating system can further include a controller communicably coupled to the first temperature sensor and the second temperature sensor, where the controller determines an amount of heated water in the tank based on one or more algorithms and measurements made by the first and second temperature sensors.

19 Claims, 7 Drawing Sheets

(51) Int. Cl.

| | |
|---|---|
| ***F24H 15/225*** | (2022.01) |
| ***F24H 15/174*** | (2022.01) |
| ***F24H 15/355*** | (2022.01) |
| ***F24H 15/395*** | (2022.01) |
| *F24H 15/238* | (2022.01) |
| *F24H 15/215* | (2022.01) |
| *F24H 15/104* | (2022.01) |
| *F24H 15/45* | (2022.01) |
| *F24H 15/12* | (2022.01) |
| *F24H 15/486* | (2022.01) |
| *F24H 15/31* | (2022.01) |
| *F24H 15/20* | (2022.01) |
| *F24H 15/421* | (2022.01) |
| *F24H 15/242* | (2022.01) |

(56) References Cited

U.S. PATENT DOCUMENTS

| | | | | |
|---|---|---|---|---|
| 10,415,851 | B2 | 9/2019 | Watts et al. | |
| 10,443,894 | B2 | 10/2019 | Branecky et al. | |
| 10,564,660 | B2 | 2/2020 | Sobieski et al. | |
| 10,684,023 | B2 * | 6/2020 | Chaudhry | F24D 19/1051 |
| 10,895,387 | B2 * | 1/2021 | Chaudhry | F24D 19/1069 |
| 11,287,144 | B2 * | 3/2022 | Porwal | F24D 19/1048 |
| 11,293,667 | B2 * | 4/2022 | Porwal | F24H 1/18 |
| 2011/0211612 | A1 * | 9/2011 | Branecky | G01K 1/026<br>374/E13.001 |
| 2014/0241708 | A1 | 8/2014 | Chaudhry et al. | |
| 2015/0226460 | A1 * | 8/2015 | Zemach | F24D 19/1063<br>126/640 |
| 2018/0142922 | A1 | 5/2018 | Knoeppel et al. | |

* cited by examiner

REAL-TIME HEATED WATER SUPPLY MEASUREMENT SYSTEMS FOR WATER HEATERS AND METHODS THERETO

RELATED APPLICATIONS

The present application is a continuation application of U.S. patent application Ser. No. 15/931,838 filed May 14, 2020, the entire contents of which is incorporated herein by reference.

FIELD OF THE DISCLOSURE

The present disclosure relates generally to water heaters, and more particularly to systems, methods, and devices for determining, in real time, a current heated water supply in a storage-type water heater.

BACKGROUND

Water heaters are generally used to provide a supply of hot water and can be used in a number of different residential, commercial, and industrial applications. A water heater can supply heated water to a number of different processes. For example, a water heater in a residential dwelling can be used for an automatic clothes washer, an automatic dishwasher, one or more showers, and one or more sink faucets. Every storage-type water heater has a limited capacity, and so when one or more processes use hot water at one time, there may be limited or no heated water available from the storage-type water heater until the water heater has sufficient time to heat more water. Systems and methods to integrate such systems in a user-friendly manner are desirable.

SUMMARY

In general, in one aspect, the disclosure relates to a water heating system. The water heating system can include a water heater that includes a tank, an inlet line, and an outlet line, where the inlet line provides unheated water to the tank, and where the outlet line draws heated water from the tank. The water heating system can also include a first temperature sensor disposed toward a top end of the tank, where the first temperature sensor measures a first temperature of water toward the top end of the tank. The water heating system can further include a second temperature sensor disposed toward a bottom end of the tank, where the second temperature sensor measures a second temperature of the water toward the bottom end of the tank. The water heating system can also include a controller communicably coupled to the first temperature sensor and the second temperature sensor, where the controller determines an amount of heated water in the tank based on one or more algorithms and measurements made by the first temperature sensor toward the top end of the tank and the second temperature sensor toward the bottom end of the tank. The one or more algorithms can be used to solve for at least one calculated temperature for at least one point between a first location of the first temperature sensor and a second location of the second temperature sensor along a height of the tank, where the amount of heated water in the tank is determined using the at least one calculated temperature.

In another aspect, the disclosure can generally relate to a water heater controller that includes a processor. The processor can be configured to communicate with a first temperature sensor and a second temperature sensor to receive a plurality of measurements associated with heated water within a tank of a water heater, where the first temperature sensor is disposed toward a top end of the tank and measures a first temperature of water toward the top end of the tank, and where the second temperature sensor is disposed toward a bottom end of the tank and measures a second temperature of water toward the bottom end of the tank. The processor can also be configured to determine, using the plurality of measurements and one or more algorithms, how much heated water is currently available within the tank of the water heater. The one or more algorithms can be used to solve for at least one calculated temperature at a plurality of points between a first location of the first temperature sensor and a second location of the second temperature sensor along a height of the tank, where the amount of heated water in the tank is determined using the at least one calculated temperature.

Also disclosed herein are methods of using the same.

These and other aspects of the present disclosure are described in the Detailed Description below and the accompanying figures. Other aspects and features of examples of the present disclosure will become apparent to those of ordinary skill in the art upon reviewing the following description of specific, examples of the present disclosure in concert with the figures. While features of the present disclosure may be discussed relative to certain examples and figures, all examples of the present disclosure can include one or more of the features discussed herein. Further, while one or more examples may be discussed as having certain advantageous features, one or more of such features may also be used with the various examples of the disclosure discussed herein. In similar fashion, while examples may be discussed below as device, system, or method examples, it is to be understood that such examples can be implemented in various devices, systems, and methods of the present disclosure.

BRIEF DESCRIPTION OF THE DRAWINGS

The accompanying drawings, which are incorporated in and constitute a part of this specification, illustrate multiple examples of the presently disclosed subject matter and serve to explain the principles of the presently disclosed subject matter. The drawings are not intended to limit the scope of the presently disclosed subject matter in any manner.

DETAILED DESCRIPTION

Figure 1A:
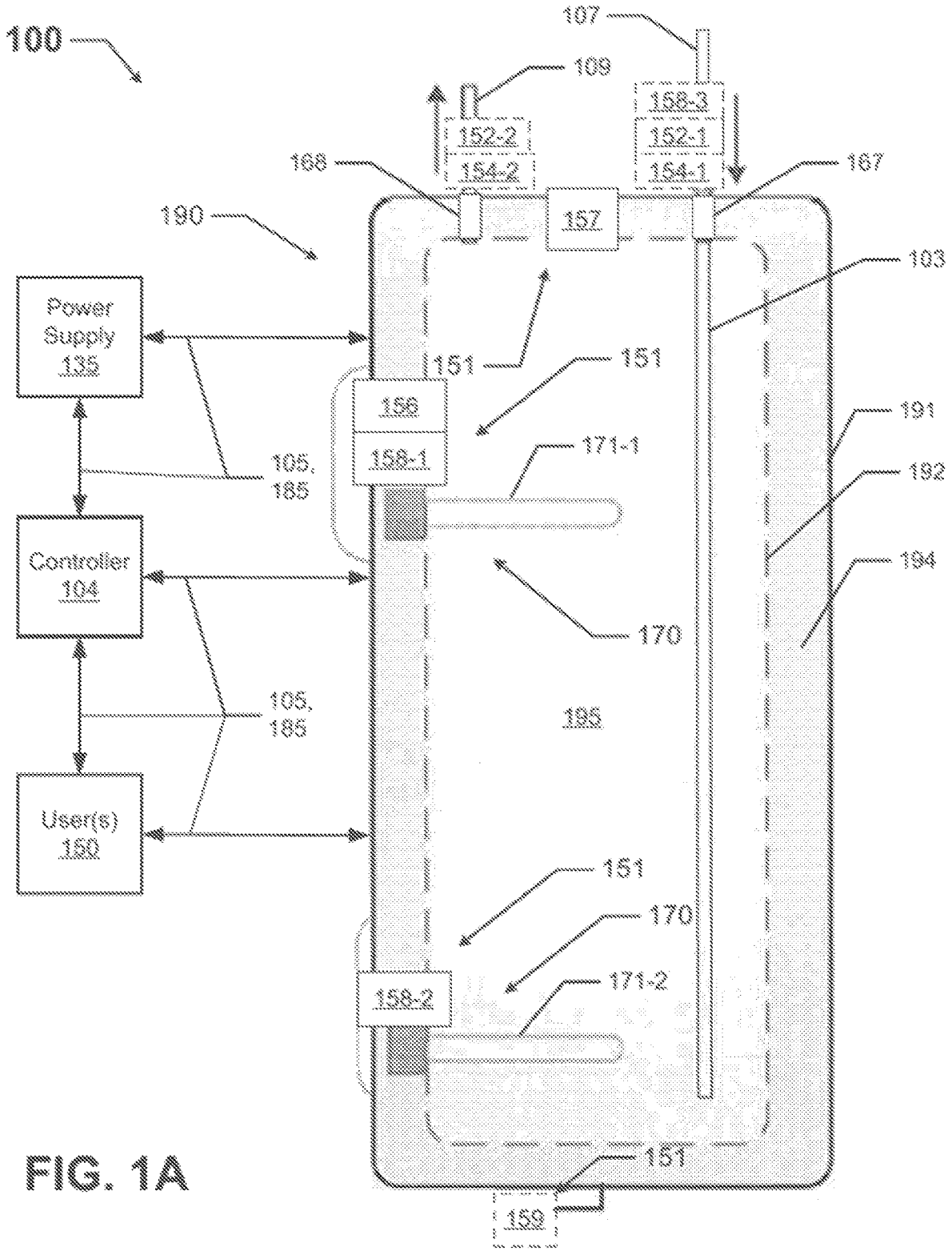
FIG. 1A illustrates a schematic diagram of a water heating system in accordance with some examples of the present disclosure.

In general, the present disclosure can provide systems, methods, and devices for determining the supply of hot water (also called heated water herein) in a storage-type water heater. Some examples can be used for any size (e.g., capacity) of water heater. Further, some examples can be located in any type of environment (e.g., warehouse, attic, garage, storage, mechanical room, basement) for any type (e.g., commercial, residential, industrial) of user. In addition, other examples can be used with any type of water heater, including but not limited to electric water heaters, gas water heaters, and heat pump water heaters. Water heaters used with examples of the present disclosure can be used for one or more of any number of processes (e.g., automatic clothes washers, automatic dishwashers, showers, sink faucets, heating systems, humidifiers).

The examples of the present disclosure can make a number of determinations with respect to hot water available from a water heater. For instance, some examples can determine how much hot water is currently in the tank of a water heater. As other examples, the present disclosure can provide the temperature of the hot water that is currently available in the tank of the water heater. As yet another example, if the tank of a water heater is out of hot water, or if the tank of a water heater does not have enough hot water for a current use, the present disclosure can estimate how long it will take for the water heater to generate a certain amount of hot water.

As will be appreciated, a water heater can include temperature sensors to, for example, detect and/or provide data indicative of the water temperature at one or more locations in the water heater's tank or other areas or components of the water heater. Typically, an increased number of temperature sensors can be used to provide increased granularity of the resulting temperature data. For example, it may be useful to detect water temperature at multiple locations within a water heater's tank to account for thermal stratification or other phenomena. Increasing the number of temperature sensors, however, can have negative impacts on the resulting system, such as increased manufacturing costs, increased maintenance/replacement costs, increased complexity of the overall system, and increased difficulty of product design and/or manufacturing (e.g., including multiple temperature sensors may make it increasingly difficult to include other necessary or advantageous components while meeting product specifications and/or minimizing the physical size of the water heater).

Thus, it can be advantageous to provide as granular of temperature data as possible based on temperature data measured by a relatively low number of temperature sensors. Accordingly, the disclosed technology provides systems and methods for determining and/or providing granular water temperature data based on as low as two temperature sensors. The disclosed technology, however, is not limited to systems including only two temperature sensors and can also include and/or be applied to systems including three, four, five, six, or more temperature sensors.

The present disclosure can also trigger and implement one or more corrective actions in response to the determination with respect to hot water availability. For example, as described above, the system can determine that the tank of a water heater does not have enough hot water for a current use. The system can then instruct one or more boilers, for example, to activate to heat additional water. By way of another example, as described above, the system can determine the temperature of all or some (e.g., one or more portions of the whole) of the hot water that is currently stored in the tank of a water heater and available for use. The system can determine that the temperature of at least some of the stored hot water is below a set point, and the system can instruct one or more agitators to mix the water in the water tank to more uniformly distribute the hot water and subsequently raise the temperature in the water tank.

Although certain examples of the disclosure are explained in detail, it is to be understood that other examples are contemplated. Accordingly, it is not intended that the disclosure is limited in its scope to the details of construction and arrangement of components set forth in the following description or illustrated in the drawings. Other examples of the disclosure are capable of being practiced or carried out in various ways. Also, in describing the examples, specific terminology will be resorted to for the sake of clarity. It is intended that each term contemplates its broadest meaning as understood by those skilled in the art and includes all technical equivalents which operate in a similar manner to accomplish a similar purpose.

Herein, the use of terms such as "having," "has," "including," or "includes" are open-ended and are intended to have the same meaning as terms such as "comprising" or "comprises" and not preclude the presence of other structure, material, or acts. Similarly, though the use of terms such as "can" or "may" are intended to be open-ended and to reflect that structure, material, or acts are not necessary, the failure to use such terms is not intended to reflect that structure, material, or acts are essential. To the extent that structure, material, or acts are presently considered to be essential, they are identified as such.

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

It is also to be understood that the mention of one or more method steps does not preclude the presence of additional method steps or intervening method steps between those steps expressly identified.

The components described hereinafter as making up various elements of the disclosure are intended to be illustrative and not restrictive. Many suitable components that would perform the same or similar functions as the components described herein are intended to be embraced within the scope of the disclosure. Such other components not described herein can include, but are not limited to, for example, similar components that are developed after development of the presently disclosed subject matter.

As used herein, the terms "steady-state" or "near-steady-state" are meant to describe a system or process wherein the variables (i.e., properties) defining the behavior of the system or process are unchanging with respect to time. That is to say, in continuous time, the partial derivate of any given variable at "steady-state" or "near-steady-state" with respect to time is at or near zero.

As used herein, the terms and/or phrases, "real-time," "substantially real-time," "instantaneously," and "substantially instantaneously" can each refer to processing and/or displaying data without intentional delay, given the processing limitations of the system (e.g., the limitations of one or more processors and/or memory of the system) and the time required to accurately measure and/or display the data.

Water heater systems (or components thereof, including controllers) described herein can be made of one or more of a number of suitable materials to allow that device and/or other associated components of a system to meet certain standards and/or regulations while also maintaining durability in light of the one or more conditions under which the devices and/or other associated components of the system can be exposed. Examples of such materials can include, but are not limited to, aluminum, stainless steel, copper, fiberglass, glass, plastic, PVC, ceramic, and rubber.

Components of a water heater system (or portions thereof) described herein can be made from a single piece (as from a mold, injection mold, die cast, or extrusion process). In addition, or in the alternative, components of a water heater system (or portions thereof) can be made from multiple pieces that are mechanically coupled to each other. In such a case, the multiple pieces can be mechanically coupled to each other using one or more of a number of coupling methods, including but not limited to epoxy, welding, soldering, fastening devices, compression fittings, mating threads, and slotted fittings. One or more pieces that are mechanically coupled to each other can be coupled to each other in one or more of a number of ways, including but not limited to fixedly, hingedly, removably, slidably, and threadably.

Storage-type water heaters described herein have a rated capacity (also sometimes called a nameplate capacity) and an actual capacity. These capacities are with respect to the tank of the water heater, as described below. In many cases, the actual capacity is less than the rated capacity. For example, a storage-type electric water heater with a rated capacity of 50 gallons can have an actual capacity of 45 gallons. The difference between the actual and rated capacity of a water heater can vary based on one or more of a number of factors. For example, for an electric water heater, the actual capacity can be 90% of the nameplate capacity, as a common example. Alternatively, or additionally, for a gas water heater, the actual capacity can be 95% of the nameplate capacity, as a common example. Examples described herein are directed to the actual capacity of the tank of the storage-type water heater, regardless of whether the water heater uses electricity, gas, or any other form of energy. The actual capacity is the amount of hot water that a tank can hold. The actual capacity can vary based on one or more of a number of factors, including but not limited to the configuration of heating elements, the energy source (e.g., electricity, natural gas) used for the heating system, and the construction of the tank.

In the foregoing figures showing examples of water heaters with real-time hot water supply determination, one or more of the components shown may be omitted, repeated, and/or substituted. Accordingly, examples of water heaters with real-time hot water supply determination should not be considered limited to the specific arrangements of components shown in any of the figures. For example, features shown in one or more figures or described with respect to one example can be applied to another example associated with a different figure or description. In addition, if a component of a figure is described but not expressly shown or labeled in that figure, the label corresponding to that component that is shown in another figure can be inferred to that component.

Examples of water heaters with real-time hot water supply determination will be described more fully hereinafter with reference to the accompanying drawings, in which examples of water heaters with real-time hot water supply determination are shown. Water heaters with real-time hot water supply determination may, however, be embodied in many different forms and should not be construed as limited to the examples set forth herein. Rather, these examples are provided so that this disclosure will be thorough and complete, and will fully convey the scope of water heaters with real-time hot water supply determination to those of ordinary skill in the art. Like, but not necessarily the same, elements (also sometimes called components) in the various figures are denoted by like reference numerals for consistency.

Figure 1B:
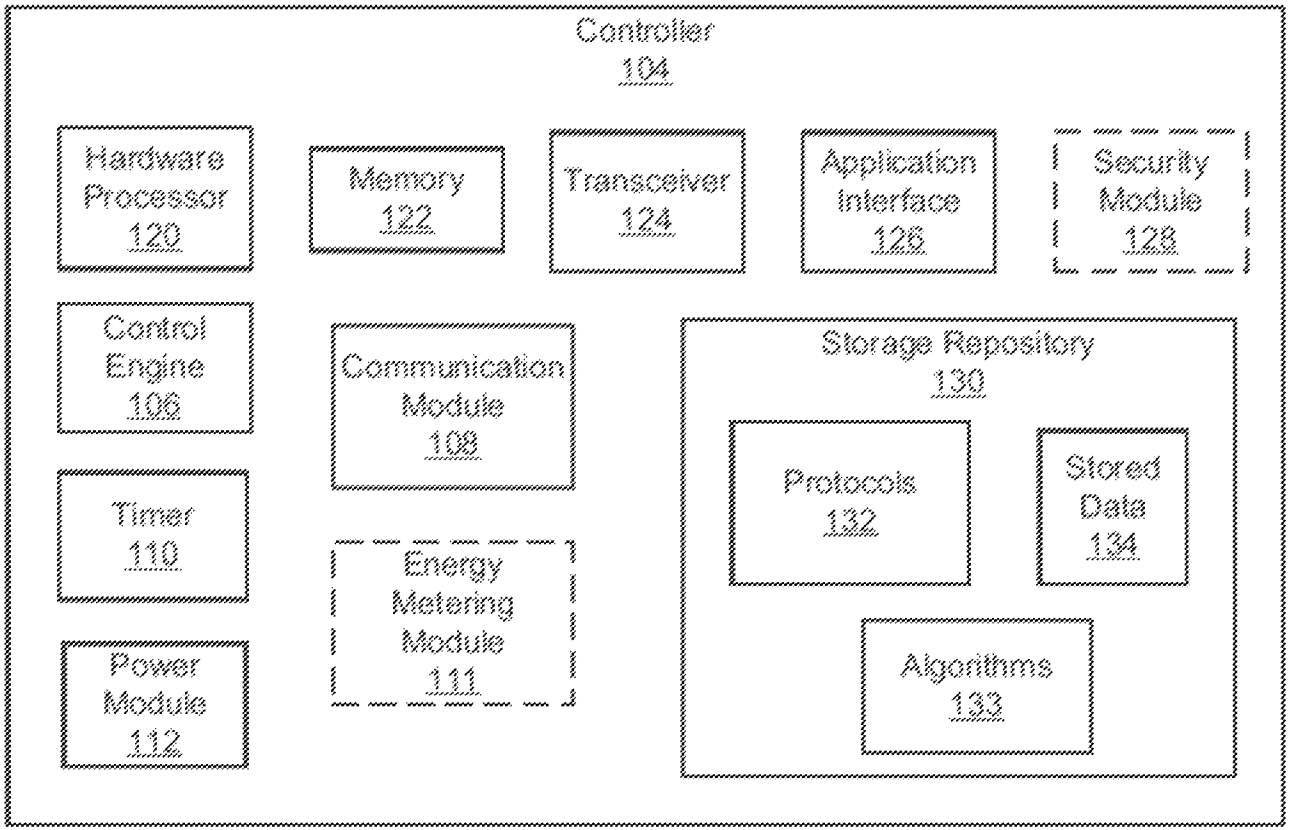
FIG. 1B illustrates a component diagram of a water heating controller in accordance with some examples of the present disclosure.

FIGS. 1A and 1B show diagrams of a water heating system 100 that includes a water heater 190 that is controlled (or at least monitored) by a controller 104 in accordance with certain examples of the present disclosure. Specifically, FIG. 1A shows the water heating system 100, and FIG. 1B shows a detailed system diagram of the controller 104. As shown in FIGS. 1A and 1B, the water heating system 100 can include the water heater 190, the controller 104, an inlet line 107, an outlet line 109, multiple sensors 151, a power supply 135, and a user device 150. An example water heater 190 is illustrated schematically in FIG. 1A and can include one or more sensor devices 151 (also sometimes called sensor modules 151 or sensors 151), a dip tube 103, an inlet fitting 167, an outlet fitting 168, a tank 195, and a heating system 170.

As stated above, the water heater 190 can include multiple sensor devices 151, a dip tube 103, an inlet fitting 167, an outlet fitting 168, a tank 195, and a heating system 170. The water heater 190 can have an outer wall 191 and an inner wall 192, where the inner wall 192 forms the tank 195. Insulation 194 can be disposed between the outer wall 191 and the inner wall 192 to help the tank 195 to retain heat longer. The inlet fitting 167 can be disposed within the insulation 194 and can couple to the inlet line 107 at its top end and to the dip tube 103 at its bottom end. The outlet fitting 168 can also be disposed within the insulation 194 and can couple to the outlet line 109 at its top end. In this example, both the inlet fitting 167 and the outlet fitting 168 can be disposed at the top end of the water heater 190.

The inlet line 107 can be a pipe or other vessel that delivers unheated water to the tank 195 of the water heater 190. Alternatively, or additionally, the inlet line 107 can be disposed on a side of the tank 195. The distal end of the inlet line 107 can be coupled, directly or indirectly, to the top end of the inlet fitting 167. The bottom end of the inlet fitting can be coupled to the proximal end of the dip tube 103, which can be disposed entirely within the water heater 190. The dip tube 103 can allow for the flow of unheated water into the tank 195 of the water heater 190. The dip tube 103 can have a distal end that can be disposed at any point within the tank 195. Typically, as in this case, the distal end of the dip tube 103 can be disposed near the bottom end of the tank 195. In such a manner, the dip tube 103 can be configured to ensure incoming cold water flows into the tank 195 at the bottom of the tank 195. In some examples, the inlet line 107 can provide water directly into the tank 195 without the use of the dip tube 103 (e.g., if the inlet line 107 is located on a side of the tank 195). The top end of the outer wall 191 and the inner wall 192 of the water heater 190 can have an aperture in which the inlet fitting 167 can be disposed therein. This configuration can allow water (usually unheated water) to flow from an external source into the tank 195 of the water heater 190. It should be understood that the inlet line 107, the inlet fitting 167, and the aperture can be positioned on any surface of the tank 195 as desired by those of ordinary skill in the art.

Similarly, the outlet line 109 can be a pipe or other vessel that can allow for the heated water in the tank 195 to flow out of the water heater 190. The outlet line 109 can have a distal end that can be disposed at any point within the tank 195. Typically, as in this case, the distal end of the outlet line 109 can be disposed near the top end of the tank 195. Alternatively, or additionally, the outlet line 109 can be disposed on a side of the tank 195. The top end of the outer wall 191 and the inner wall 192 of the water heater 190 can have an aperture in which the outlet fitting 168 can be disposed. A segment of the outlet line 109 can be coupled to the bottom end of the outlet fitting 168, allowing that segment of the outlet line 109 to extend into the tank 195. The remainder of the outlet line 109 can be coupled to the top end of the outlet fitting 168. This configuration can allow heated water in the tank 195 to be drawn from the tank 195 of the water heater 190 so that the heated water can be delivered to one or more of a number of devices (e.g., clothes washer, dishwasher, faucets, shower heads) that use the heated water. It should be understood that the outlet line 109, the outlet fitting 168, and an aperture that each is disposed therethrough can be positioned on any surface of the tank 195 as desired by those of ordinary skill in the art.

Each of the sensor devices 151 can measure one or more of a number of parameters. Examples of types of sensors 151 can include, but are not limited to, a temperature sensor (e.g., a thermometer, a thermistor, a thermocouple, a resistance thermometer), a pressure sensor, a flow rate sensor, a scale, a voltmeter, an ammeter, a power meter, an ohmmeter, an electric power meter, and a resistance temperature detector. A sensor 151 can also include one or more components and/or devices (e.g., a potential transformer, a current transformer, electrical wiring) related to the measurement of a parameter.

A parameter that can be measured by a sensor 151 can include, but is not limited to, pressure, flow rate, current, voltage, power, resistance, weight, and temperature. The parameter or parameters measured by a sensor 151 can be used by the controller 104 to determine an amount of heated water that is currently available within the tank 195 of the water heater 190 and/or how long it will take for an amount of heated water within the tank 195 of the water heater 190 to become available. Each sensor 151 can use one or more of a number of communication protocols. A sensor 151 can be a stand-alone device or integrated with another component (e.g., the heating system 170) in the system 100. A sensor 151 can measure a parameter continuously, periodically, based on the occurrence of an event, based on a command received from the processor 106 of the controller 104, and/or based on some other factor.

For example, there can be three temperature sensors 158 (temperature sensor 158-1, temperature sensor 158-2, and temperature sensor 158-3), at least one flow sensor 154, and a water leak sensor 159, all of which are types of sensors 151. The water leak sensor 159 can be disposed toward the bottom end of the water heater 190 and can detect a leak in the tank 195 of the water heater 190. The flow sensor 154 can measure the rate of flow of unheated water in the inlet line 107 when entering the tank 195. The temperature sensor 158-1 can be located toward the top end (e.g., approximately ¼ the height of the tank 195 from the top end of the tank 195) and can measure the temperature of the water (e.g., heated water, unheated water, mixture of heated water and unheated water) in the tank 195 at that point. This temperature measured by the temperature sensor 158-1 can be an indication of the maximum temperature of the heated water in the tank 195, although, since heat rises, the temperature of the heated water in the tank 195 above the temperature sensor 158-1 can be the same or higher than the temperature measured by the temperature sensor 158-1.

Temperature sensor 158-2 can be located toward the bottom end (e.g., approximately ¼ the height of the tank 195 from the bottom end of the tank 195) and can measure the temperature of the water (e.g., heated water, unheated water, mixture of heated water and unheated water) in the tank 195 at that point. Since heat rises, the temperature measured by the temperature sensor 158-2 can be less than the temperature measured by the temperature sensor 158-1. If this is not the case, the controller 104 can determine that the temperature sensor 158-1 and/or the temperature sensor 158-2 can be faulty and require maintenance and/or replacement. The controller 104 can also implement one or more corrective actions, such as agitating the water in the tank 195 to confirm the faulty temperature reading.

The temperature sensor 158-3 can measure the temperature of the unheated water in the inlet line 107 before the unheated water flows into the tank 195. The controller 104 can use the measurements made by some or all of these sensors 151 to determine such things as the amount of heated water available in the tank 195 for immediate use and how long it will take for a certain amount of heated water to become available in the tank 195.

Although three different temperature sensors 158-1, 158-2, 158-3 are discussed in the above example. The disclosed technology includes water heaters 190 include two, four, five, six, or any other number of temperature sensors 158. For example, two, three, four, or more temperature sensors 158 can be located within the tank 195 or otherwise configured to detect and provide temperature readings of water at a given location within the tank 195.

The water heater 190 can also include one or more valves 152. In this example, the water heater 190 can include an inlet valve 152-1 that controls the rate of flow (or the flow itself) of the unheated water in the inlet tube 107, as well as an outlet valve 152-2 that controls the rate of flow (or the flow itself) of heater water in the outlet tube 109. The position (e.g., fully open, fully closed, 30% open) of a valve 152 can be controlled by the controller 104. The water heater 190 can further include a switch 156 (also called an emergency cutout switch 156 or an ECO switch 156) that can control the energy (e.g., electrical power, gas) delivered to the heating system 170. The switch 156 can have an open position (preventing energy from flowing to the heating system 170) and a closed position (allowing energy to flow to the heating system 170). The position and operation of the switch 156 can be independent of the controller 104.

The water heater 190 can also include a temperature and pressure relief valve 157 that is disposed in the top of the tank 195, the top of the outer wall 191, and the insulation disposed therebetween. The relief valve 157 can be a purely mechanical device (e.g., not controlled by the controller 104) that detects when the pressure and/or temperature within the tank 195 exceeds a threshold value for that parameter. If such an event were to occur, the relief valve 157 would operate from a normally closed position to an open position.

If the relief valve 157 can determine that the pressure within the tank 195 exceeds a maximum threshold value, then the relief valve 157 can open to allow the excess pressure to vent out the top of the water heater 190 into the ambient environment. When the pressure within the tank 195 measured by the relief valve 157 falls back within a safe range (another threshold value), then the relief valve 157 can return to the closed position. Similarly, if the relief valve 157 determines that the temperature within the tank 195 exceeds a maximum threshold value, then the relief valve 157 can open to allow the excess temperature to vent out the top of the water heater 190 into the ambient environment. When the temperature within the tank 195 measured by the relief valve 157 falls back within a safe range (another threshold value), then the relief valve 157 can return to the closed position.

The heating system 170 of the water heater 190 can include one or more devices (or components thereof) that consume energy (e.g., electricity, natural gas, propane) during operation. An example of such a device or component of the heating system 170 can include the heating elements 171 shown in FIG. 1A. FIG. 1A depicts two heating elements 171 that extend toward the center of the tank 195. Any number of heating elements 171 can be included, however. For example, three, four, five, six, ten, fifteen, or more heating elements 171 can be included. Heating element 171-1 can be located toward the top of the tank 195 (e.g., approximately ⅓ the height of the tank 195 from the top end of the tank 195). Heating element 171-2 can be located toward the bottom of the tank 195 (e.g., approximately ⅙ the height of the tank 195 from the bottom end of the tank 195). Alternatively, or additionally, the heating system 170 can include a single heating element 171, such as a gas burner. In such an example, the heating element 171 can be located at the bottom end of the tank 195. It should be understood that any number of heating devices can be used and positioned throughout the tank 195 as desired by those of skill in the art.

Those of ordinary skill in the art will appreciate that heating systems 170 for water heaters 190 can have any of a number of other configurations. In any case, the controller 104 (and the settings/programming thereof) is aware of the devices, components, ratings, positioning, and any other relevant information regarding the heating system 170 relative to the tank 195. In some cases, one or more devices of the heating system 170 can have its own local controller. In such a case, the controller 104 can communicate with the local controller of the heating system 170 using signal transfer links 105 and/or power transfer links 185.

The tank 195 can also include one or more agitators (not shown). The agitators can include, for instance, impellers, stirrers, bubblers, and the like. The agitators can be present to agitate the water in the tank 195 such that hot water is evenly distributed.

As shown in FIG. 1B, the controller 104 can include one or more of a number of components. Such components, can include, but are not limited to, a processor 106, a communication module 108, a storage repository 130, a memory 122, a transceiver 124, an application interface 126, and, a security module 128. The components shown in FIGS. 1A and 1B are not exhaustive, and in some examples, one or more of the components shown in FIGS. 1A and 1B may not be included in an example system. Further, one or more components shown in FIGS. 1A and 1B can be rearranged. For example, some or all of the inlet line 107 can be a part of the water heater 190. Any component of the example water heating system 100 can be discrete or combined with one or more other components of the water heating system 100.

The user device 150 can use and/or include a user system (not shown, but such as a smart phone or a laptop computer), which may include a display (e.g., a GUI). The user device 150 can interact with (e.g., send data to, receive data from) the controller 104 via the application interface 126 (described below). The user device 150 can also interact with the water heater 190 (including any components thereof, such as one or more of the sensor devices 151) and/or the power supply 135. Interaction between a user device 150, the controller 104, the water heater 190, and the power supply 135 is conducted using signal transfer links 105 and/or power transfer links 185.

Each signal transfer link 105 and each power transfer link 185 can include wired (e.g., Class 1 electrical cables, Class 2 electrical cables, electrical connectors, electrical conductors, electrical traces on a circuit board, power line carrier, DALI, RS485) and/or wireless (e.g., Wi-Fi, visible light communication, Zigbee, mobile apps, text/email messages, cellular networking, Bluetooth, WirelessHART, ISA100) technology. For example, a signal transfer link 105 can be (or include) one or more electrical conductors that are coupled to the controller 104 and to a sensor device 151 of the water heater 190. A signal transfer link 105 can transmit signals (e.g., communication signals, control signals, data) between the controller 104, a user device 150, the water heater 190 (including components thereof), and/or the power supply 135.

Similarly, a power transfer link 185 can transmit power between the controller 104, a user device 150, the water heater 190 (including components thereof), and/or the power supply 135. One or more signal transfer links 105 and/or one or more power transfer links 185 can also transmit signals and power, respectively, between components (e.g., temperature sensor 158-2, optional flow sensor 154-1) within the water heater 190 and/or within the controller 104.

The power supply 135 can provide power, directly or indirectly, to one or more components (e.g., the sensor devices 151, the controller 104, the heating system 170, a system of a user device 150) of the water heating system 100. The power supply 135 can include one or more components (e.g., a transformer, a fuse) that receives power (for example, through an electrical cable) from an independent power source external to the heating system 100 and generates power of a type (e.g., AC, DC) and level (e.g., 240V, 120V) that can be used by one or more components of the heating system 100. For example, the power supply 135 can provide 240 VAC power to the heating system 170 of the water heater 190. In addition, or in the alternative, the power supply 135 can be or include a source of power in itself. For example, the power supply 135 can be or include a battery, a localized photovoltaic power system, or some other source of independent power.

A user device 150, the power supply 135, and/or the water heater 190 (including the sensors 151 and a local controller, if any) can interact with the controller 104 using the application interface 126 in accordance with one or more examples. Specifically, the application interface 126 of the controller 104 receives data (e.g., information, communications, instructions, updates to firmware) from and sends data (e.g., information, communications, instructions) to a user device 150, the power supply 135, and/or the water heater 190. The user device 150, the power supply 135, and the water heater 190 (including portions thereof) can include an interface to receive data from and send data to the controller 104. Examples of such an interface can include, but are not limited to, a graphical user interface, a touchscreen, an application programming interface, a keyboard, a monitor, a mouse, a web service, a data protocol adapter, some other hardware and/or software, or any suitable combination thereof.

The controller 104 can be a stand-alone device or integrated with another component (e.g., the water heater 190) in the water heating system 100. When the controller 104 is a stand-alone device, the controller 104 can include a housing. In such a case, the housing can include at least one wall that forms a cavity. In some cases, the housing can be designed to comply with any applicable standards so that the controller 104 can be located in a particular environment (e.g., a hazardous environment, a high temperature environment, a high humidity environment).

The storage repository 130 can be a persistent storage device (or set of devices) that stores software and data used to assist the controller 104 in communicating with a user device 150, the power supply 135, and water heater 190 (including components thereof) within the heating system 100. In one or more examples, the storage repository 130 stores one or more protocols 132, one or more algorithms 133, and stored data 134. The protocols 132 can be any procedures (e.g., a series of method steps) and/or other similar operational procedures that the processor 106 of the controller 104 follows based on certain conditions at a point in time. The protocols 132 can include any of a number of communication protocols 132 that are used to send and/or receive data between the controller 104 and a user device 150, the power supply 135, and the water heater 190.

The algorithms 133 can be or include any formulas, mathematical models, and/or other suitable means of manipulating and/or processing data. One or more algorithms 133 can be used for a particular protocol 132. As discussed above, the controller 104 uses information (e.g., temperature measurements) provided by the sensor devices 151 to generate, using one or more protocols 132 and/or one or more algorithms 133, information related to the availability of heated water in the tank 195 of the water heater 190 to a user device 150.

For example, a protocol 132 and/or an algorithm 133 can dictate when a measurement is taken by a sensor device 151 and which particular sensor devices 151 take a measurement at that point in time. As another example, a protocol 132 and/or an algorithm 133 can be used, in conjunction with measurements made by one or more sensor devices 151, by the controller 104 to determine how much heated water is in the tank 195 of the water heater 190 and available for immediate use by a user device 150.

As yet another example, a protocol 132 and/or an algorithm 133 can be used by the controller 104 to determine whether the amount of heated water currently in the tank 195 is insufficient for a desired use of a user device 150. In such a case, the controller 104 can use a protocol 132 and/or an algorithm 133 to determine how long it will take for the proper amount of water in the tank 195 to be heated and ready for a particular use. As still another example, a protocol 132 and/or an algorithm 133 can be used by the controller 104 to alter, suspend, and/or resume operation of the heating system 170.

Stored data 134 can be any data associated with the water heating system 100 (including any components thereof), any measurements taken by the sensor devices 151, time measured by the timer 110, adjustments to an algorithm 133, threshold values, set point values, user preferences, default values, results of previously run or calculated algorithms 133, and/or any other suitable data. Such data can be any type of data, including but not limited to historical data for the water heating system 100 (including any components thereof, such as the sensor devices 151 and the heating system 170), present data (e.g., calculations, adjustments made to calculations based on actual data, measurements taken by one or more sensor devices 151), and forecasts. The stored data 134 can be associated with some measurement of time derived, for example, from the timer 110.

The processor 106 can be configured to perform a number of functions that help the controller 104 make a determination that relates to the amount of heated water in the tank 195 of the water heater 190 at a particular point in time. For example, the processor 106 can execute any of the protocols 132 and/or algorithms 133 stored in the storage repository 130 and use the results of those protocols 132 and/or algorithms 133 to communicate to a user device 150 an amount of heated water currently available in the tank 195 of the water heater 190. As another example, if there is an insufficient amount of heated water currently available in the tank 195 of the water heater 190, the processor 106 can execute other protocols 132 and/or algorithms 133 and use the results of those protocols 132 and/or algorithms 133 to communicate to a user device 150 how long it will take to achieve some amount of heated water within the tank 195 of the water heater 190.

Using one or more algorithms 133, the processor 106 can predict the expected useful life of these components based on stored data 134, a protocol 132, one or more threshold values, and/or some other factor. The processor 106 can also measure (using one or more sensors 151) and analyze the efficiency of the water heater 190 over time. An alarm can be generated by the processor 106 when the efficiency of a component of the water heating system 100 falls below a threshold value, indicating failure of that component.

The processor 106 can also implement and execute a number of corrective actions. For example, if the processor 106 determines there is an insufficient amount of heated water within the tank 195 of the water heater 190, the processor 106 can control one or more components (e.g., the heating system 170, a valve 152) to get the amount of heated water within the tank 195 of the water heater 190 to within an acceptable range of values (e.g., default values, user-selected values such as set point values). In the case of a gas heater, the one or more corrective actions can include increasing a blower speed to increase oxygen concentration and, therefore, the rate of combustion to increase the temperature of the water heater. The processor 106 can also adjust the predetermined threshold to activate the heating system 170 if it is detected that the temperature in the tank is dropping. In such a manner, the combustion in the heating system 170 can begin sooner than normal to provide additional heating power to the water heater. The one or more corrective actions can also include combinations of the aforementioned corrective actions.

The processor 106 can perform its evaluation functions and resulting actions on a continuous basis, periodically, during certain time intervals, or randomly. Further, the processor 106 can perform this evaluation for the present time or for a period of time in the future. For example, the processor 106 can perform forecasts to determine the volume of heated water that will be in the tank 195 of the water heater 190 after a specified period of time. The processor 106 can adjust a forecast (e.g., every hour, when new information from a user device 150 or a sensor device 151 is received).

The processor 106 of the controller 104 can communicate with one or more components (e.g., a network manager) of a system external to the water heating system 100. For example, the processor 106 can interact with an inventory management system by ordering a component (e.g., a sensor device 151) to replace a sensor device 151 (e.g., optional temperature sensor 158-3) that the processor 106 has determined has failed or is failing. As another example, the processor 106 can interact with a workforce scheduling system by scheduling a maintenance crew to repair or replace a component of the water heating system 100 when the processor 106 determines that the component requires maintenance or replacement.

The communication module 108 can send and receive data between the power supply 135, the water heater 190 (or components thereof), and/or the user devices 150 and the controller 104. The communication module 108 can send and/or receive data in a given format that follows a particular protocol 132. The processor 106 can interpret the data packet received from the communication module 108 using the protocol 132 information stored in the storage repository 130. The processor 106 can also facilitate the data transfer between the water heater (or components thereof), the power supply 135, and a user device 150 by converting the data into a format understood by the communication module 108.

The transceiver 124 of the controller 104 can send and/or receive control and/or communication signals. Specifically, the transceiver 124 can be used to transfer data between the controller 104 and the user device 150, the power supply 135, and the water heater 190 (or portions thereof). The transceiver 124 can include a transmitter, a receiver, or a combination of the two. The transceiver 124 can use wired and/or wireless technology. The transceiver 124 can be configured in such a way that the control and/or communication signals sent and/or received by the transceiver 124 can be received and/or sent by another transceiver that is part of the user device 150, the power supply 135, and the water heater 190 (or portions thereof). The transceiver 124 can use any of a number of signal types, including but not limited to radio frequency signals.

Optionally, in one or more examples, the security module 128 can secure interactions between the controller 104, the user device 150, the power supply 135, and the water heater 190 (or portions thereof). More specifically, the security module 128 can authenticate communication from software based on security keys verifying the identity of the source of the communication. For example, user software may be associated with a security key enabling the software of a user device 150 to interact with the controller 104 and/or the sensors 151. Further, the security module 128 can restrict receipt of information, requests for information, and/or access to information in some examples.

While the following methods are described with reference to the water heating system 100, it is understood that one or more method steps or whole methods can be performed by other systems, general-purpose computers, computer operators, and the like.

Figure 2:
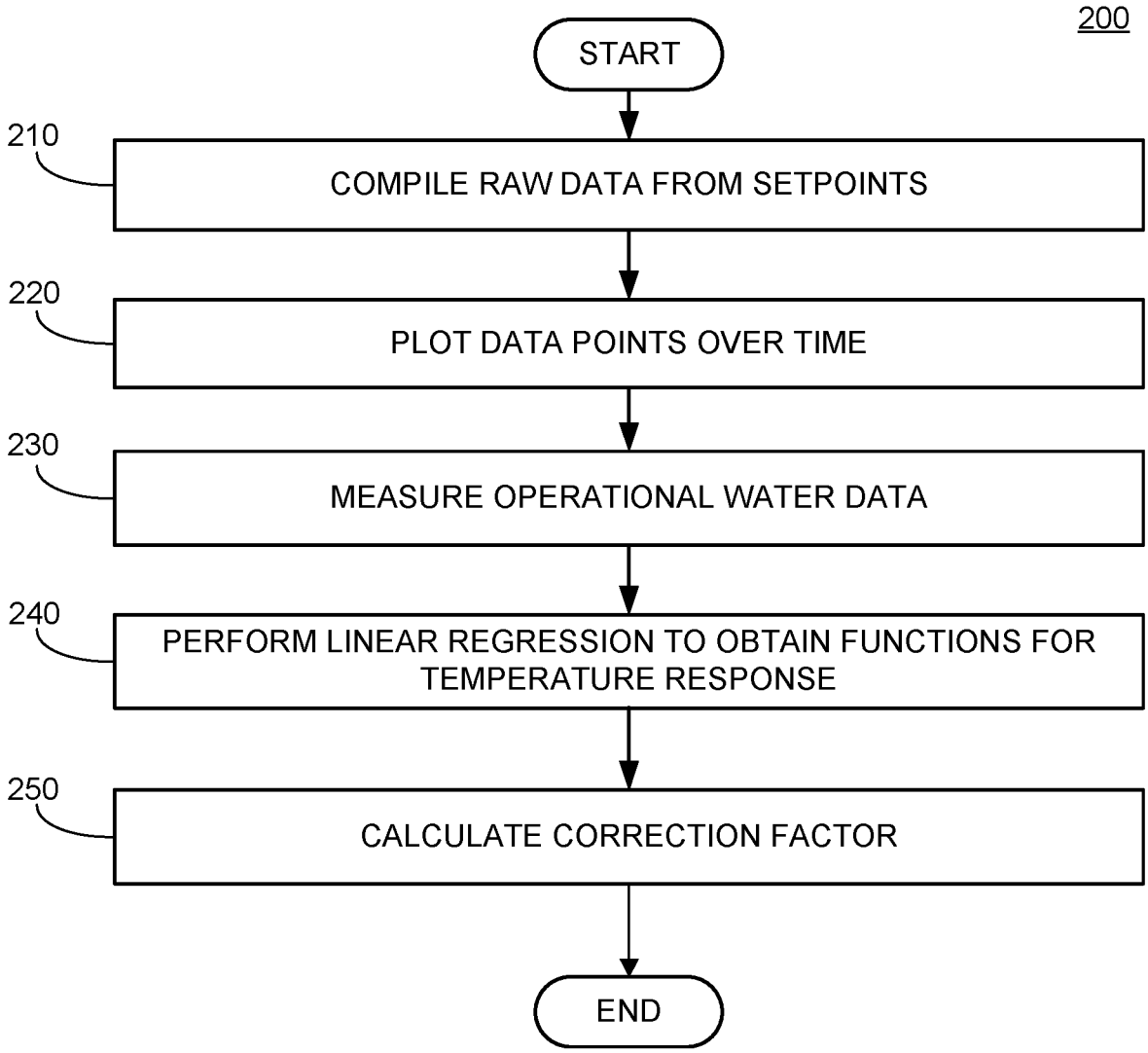
FIG. 2 illustrates a flowchart of a method for determining hot water supply in a water heater in accordance with some examples of the present disclosure.
Figure 3:
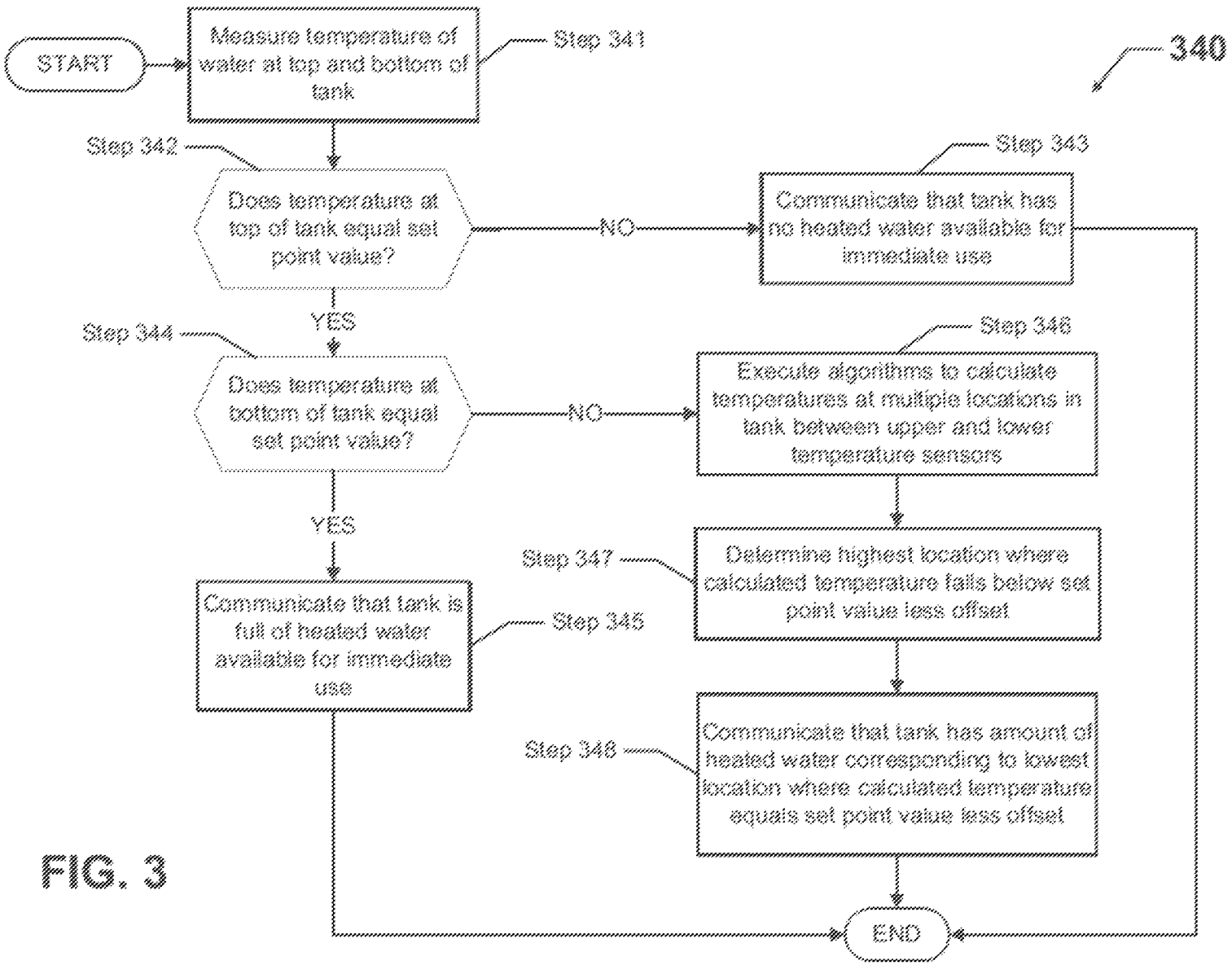
FIG. 3 illustrates a flowchart of another method for determining hot water supply in a water heater in accordance with some examples of the present disclosure.

FIGS. 2 and 3 each show a flowchart for determining hot water supply in a water heater in accordance with certain examples. While the various steps in these flowcharts are presented and described sequentially, one of ordinary skill in the art will appreciate that some or all of the steps can be executed in different orders, combined or omitted, and some or all of the steps can be executed in parallel depending upon the example. Further, in one or more of the examples, one or more of the steps described below can be omitted, repeated, and/or performed in a different order. For example, the process of managing the amount of heated water within the tank 195 can be a continuous process, such that the START and END steps shown in FIGS. 3 and 4 can merely denote the start and end of a particular series of steps within a continuous process.

In addition, additional steps not shown in FIGS. 2 and 3 can be included in performing these methods. Accordingly, the specific arrangement of steps should not be construed as limiting the scope. For the methods described below, unless specifically stated otherwise, a description of the controller 104 performing certain functions can be applied to the processor 106 of the controller 104.

For clarity, the controller 104 described herein can control other aspects of the system 100 while performing the functions described above and in the methods of FIGS. 2 and 3 below. For example, the controller 104 can control the heating system 170 independently of, or in conjunction with, the functions described herein. In such a case, the heating system 170 can be controlled in one or more of a number of ways. For example, the controller 104 can suspend operation of the heating system 170 until the temperature of the heated water drops below some minimum threshold value (e.g., a set point value, which is part of the stored data 134), at which point the controller 104 can resume operation of the heating system 170. This cycle can continue until heated water is drawn from the tank 195.

FIG. 2 illustrates a method 200 for creating and/or tuning one or more algorithms 133. The algorithms 133 from method 200 can be used with the water heating system 100, the controller 104, the method 340, or other components of the present disclosure. Alternatively, or additionally, the method 200 can be implemented by other water heaters, water heater systems, water tank controllers, general purpose computers, and the like.

The method 200 can begin at block 210. In block 210, the system 100 can compile raw data from a variety of energy setpoints, inlet temperatures, and energy input rates. The system 100 can also analyze a plurality of intermittent volume draws on the tank 195 up to the maximum volume of the tank 195. The temperature readings inside the tank 195 can be taken from two or more temperature sensors 151. Then, the method 200 can proceed on to block 220.

In block 220, the data points are plotted over time from the beginning of each draw until the temperature set point is reached. In such a manner, the temperature response of the system 100 can be analyzed to determine the behavior of the system 100 after a draw during heating. Subsequently, one or more intermediate temperature sensors can utilize the response of the two or more temperature sensors 151 without needing time information because the time from block 220 can be used. Then, the method 200 can proceed on to block 230.

In block 230, the controller 104 or the system 100 can perform linear regression on the temperature data from the two or more temperature sensors 151. In such a manner, functions can be created to model the behavior inside the tank 195 around each of the temperature sensors 151. Other numerical methods of creating functions to model the behavior can be used, such as Newton-Raphson, Euler's method, Taylor series, differential equations to predict flow as a function of energy input and temperature, and the like. The functions of each temperature sensor 151 can be aggregated to model the behavior of the tank 195 as a whole. As the number of temperature sensors 151 increases, the number of equations and the accuracy of the model can also increase. The functions can also be normalized with respect to the volume of the tank 195 and the time of the temperature response of the two or more temperature sensors 151. In such a manner, the general methodology and calculated functions can be applied to any tank 195 regardless of tank volume and/or flow rate of water. As would be appreciated, such an example can eliminate the need for a flow meter in the tank 195 when calculating the amount of hot water present because the functions are functions of temperature and independent of time. The method 200 can then proceed on to block 240.

In block 240, a correction factor can be calculated and applied to each of the functions obtained in block 230. The functions can be normalized with respect to the temperature of the water at the inlet to eliminate discrepancies due to the temperature of the incoming water. By creating a calculator that solves for the value k with all other known values, a piecewise function can be created for each temperature sensor 151 and its relative set point and BTU input rate. Then, the method 200 can terminate after block 240 or proceed on to other method steps not shown or discussed elsewhere herein. For example, after completing block 240, the method 200 can then proceed and begin the method 340.

The method 340 of FIG. 3 can begin at step 341 where the temperatures of the water at the top and bottom of the tank 195 are measured. The temperatures can be measured by one or more sensor devices 151 (e.g., temperature sensor 158-1, temperature sensor 158-2) that measure the temperature of the water within the tank 195. When multiple temperature sensors 158 are used, they can be placed at different locations within the tank 195. For example, one temperature sensor 158 (e.g., temperature sensor 158-1) can measure a temperature of the water toward the top end of the tank 195, and another temperature sensor 158 (e.g., temperature sensor 158-2) can measure a temperature of the water toward the bottom end of the tank 195. A temperature measured by a temperature sensor 158 can be an absolute temperature or a differential temperature (e.g., the difference between the temperature measured by temperature sensor 158-1 and the temperature measured by temperature sensor 158-2). The temperature sensors 158 can measure temperature based on instructions received by the controller 104. Once the temperatures are measured, the temperature sensors 158 can send the measurements to the controller 104.

Once the controller 104 receives the temperature measurements from step 341, the controller 104 evaluates those temperature measurements. For example, in step 342 a determination is made as to whether the temperature measurement toward the top end of the tank 195 exceeds or equals a set point value (a type of threshold value). The determination can be made by the controller 104 using one or more protocols 132 and/or algorithms 133 stored in the storage repository 130. The set point value can be part of the stored data 134 of the storage repository 130. The set point value can be some desired temperature at which the water toward the top end of the tank 195 can be considered heated water. The set point value can be an actual temperature value. Alternatively, the set point value can be a differential of set point values. If the temperature measurement toward the top end of the tank 195 exceeds the set point value, then the process proceeds to step 344. If the temperature measurement toward the top end of the tank 195 does not exceed the threshold value, then there is no heated water in the tank 195 and the process proceeds to step 343.

In step 343, the controller 104 communicates to a user device 150 that there is no heated water available in the tank 195 at that point in time. In some cases, an algorithm 133 is performed by the controller 104 to determine the amount of time needed to heat the water toward the top end of the tank 195 to the set point temperature value. Alternatively, an algorithm 133 can be performed by the controller 104 to determine the amount of time needed to heat the water in the entire tank 195 to the set point temperature value. The results of this algorithm 133 can also allow the controller 104 to communicate to a user device 150 the amount of heated water available for immediate use.

The controller 104 can communicate in one or more of any number of ways. For example, the controller 104 can emit, through a speaker, an audible notification. As another example, the controller 104 can send a SMS message to the mobile device of one or more user devices 150. As yet another example, the controller 104 can post a message on a display. As still another example, the controller 104 can send an email to one or more user devices 150. The controller 104 can use the transceiver 124 when communicating.

The controller 104 can also provide a display to help the user device 150 visualize the amount of heater water available. For example, the controller 104 can provide an illustration or other indication (e.g., on a GUI, UI, or display screen of the controller 104 and/or a device associated with the user device 150) of a tank 195. The illustration, for example, can include an image of the tank 195 with a level line indicating a percentage of available hot water. Alternatively, or additionally, the illustration can include a percentage value and/or a volume for hot water available. By way of another example, the illustration can include a color gradient to represent the amount of available hot water. For example, the gradient can be from red (representing hot water) to blue (representing cold water). Alternatively, or additionally, the gradient can be from green (representing readily available hot water) to white or another color (representing unheated water). Other displays and illustrations can be used to represent the amount of available hot water to the user device 150.

The controller 104 can provide an illustration or other indication (e.g., on a GUI, UI, or display screen of the controller 104 and/or a device associated with the user device 150) illustrating stratification of hot water in the tank 195. For example, the illustration can provide indicators representing each temperature sensor and one or more intermediate temperatures. The illustration can display the measured temperature at each of the lines to illustrate the temperature distribution in the tank. In such a manner, different temperature zones or bands can be illustrated. The various zones can also be color coded, as described above, to illustrate the amount of hot water.

The algorithms 133 can be stored in the storage repository 130. The algorithms 133 are performed by the controller 104. The amount of time that is determined can be based on some amount of water (e.g., 10 gallons, 22 gallons) that fills some volume of space toward the top end of the tank 195. Such an amount of water can be part of the stored data 134, can be part of a corresponding algorithm 133 and/or protocol 132, can be dictated by a user device 150, or established in some other way. The controller 104 can communicate the results of the algorithm 133 to a user device 150. When step 343 is complete, the process can conclude at the END step.

In step 344, a determination is made as to whether the temperature measurement toward the bottom end of the tank 195 exceeds a set point value (a type of threshold value). The determination can be made by the controller 104 using one or more protocols 132 and/or algorithms 133 stored in the storage repository 130. The set point value can be part of the stored data 134 of the storage repository 130. The set point value can be some minimum temperature at which the water toward the bottom end of the tank 195 can be considered heated water. The set point value corresponding to upper temperature sensor 158-1 (e.g., toward the top end of the tank 195) and the set point value corresponding to the lower temperature sensor 158-2 (e.g., toward the bottom end of the tank 195) may or may not be the same value. If the temperature measurement toward the bottom end of the tank 195 equals or exceeds the set point value, then the process proceeds to step 345. If the temperature measurement toward the bottom end of the tank 195 does not at least equal the set point value, then the process proceeds to step 346.

In step 345, a communication can be dispatched to state that the tank 195 is full of heated water that is available for immediate use. The controller 104 can perform the communication, which can be sent to a user device 150. The controller 104 can also communicate the amount of heated water that is currently available. In such a case, the amount is equal to the actual capacity of the tank 195 of the water heater 190. When step 345 is complete, the process can conclude at the END step.

In step 346, one or more algorithms 133 are executed to determine how much heated water in the tank 195 is available for immediate use. These algorithms 133 calculate temperatures at multiple locations in the tank 195 between the upper temperature sensor 158-1 and the lower temperature sensor 158-2. Additionally, the results of these algorithms 133 can allow the controller 104 to communicate with a user device 150 as to the amount of time it will take until the entire tank 195 has heated water. The algorithms 133 can be stored in the storage repository 130. The algorithms 133 are executed by the controller 104.

The algorithms 133 used to determine how much heated water is in the tank 195 at a certain point in time can involve or be derived from regression analysis, centroid equations, and/or any other system of mathematical solutions. As such, historical data (e.g., from the same water heater 190, from other similar water heaters) can be used in the regression analysis. The regression analysis can be used to alter one or more algorithms 133 over time. These algorithms 133 can be dependent upon, or independent of, one or more factors related to the water heater 190, including but not limited to the capacity of the water heater (e.g., 40 gallons, 55 gallons), the amount of heated water recently drawn from the tank 195, and the type of water heater (e.g., electric, gas, heat pump).

In general, in this example, a calculated temperature at a location in the tank 195 can be calculated as a first value times a difference between the temperature measured at the upper temperature sensor 158-1 and the temperature measured at the lower temperature sensor 158-2, where this product is added to a second value. Each of the values in this case are quadratic equations where the set point value is the variable used to solve the respective quadratic equation. As stated above, the controller 104 can adjust these formulas from time to time based on user input, historical information, actual measurements, and/or other factors.

In step 347, a determination is made as to the highest location in the tank 195 where the calculated temperature falls below the set point value. In some cases, the set point value is reduced by an offset. The determination is made by the controller 104.

In step 348, a communication can be dispatched to state the amount of heated water in the tank 195 based on the results of step 347. For instance, the communication states that the tank 195 has an amount (e.g., 63% of capacity of the tank 195, 33 gallons) of heated water that corresponds to the lowest location in the tank 195 where the calculated temperature equals the set point temperature value (in some cases, less an offset). The controller 104 can perform the communication, which can be sent to a user device 150. When step 348 is complete, the process can conclude at the END step.

Once the method 340 reaches the END step, the system 100 can implement additional corrective actions based on the determinations made during the method 340. For example, if the method 340 reaches the END step after step 343 (determining that there is no hot water available), the controller 104 can cause the heating system 170 and/or the one or more heating elements 171 to activate and create hot water. This can either be performed automatically when step 343 is reached, or the controller 104 can receive the input from the user device 150 after providing the notification that there is no hot water available. Alternatively, or additionally, the user device 150 can specify the corrective actions to take. For example, if the method 340 reaches the END step after step 348 (communicating to the user device 150 that the hot water level is low), the user device can select the corrective actions from a plurality of options. In this example, the user device 150 can send instructions to the controller 104 to simply agitate the contents of the tank 195 to more homogeneously distribute the hot water.

As used in this application, the terms "component," "module," "system," "server," "processor," "memory," and the like are intended to include one or more computer-related units, such as but not limited to hardware, firmware, a combination of hardware and software, software, or software in execution. For example, a component may be, but is not limited to being, a process running on a processor, an object, an executable, a thread of execution, a program, and/or a computer. By way of illustration, both an application running on a computing device and the computing device can be a component. One or more components can reside within a process and/or thread of execution and a component may be localized on one computer and/or distributed between two or more computers. In addition, these components can execute from various computer readable media having various data structures stored thereon. The components may communicate by way of local and/or remote processes such as in accordance with a signal having one or more data packets, such as data from one component interacting with another component in a local system, distributed system, and/or across a network such as the Internet with other systems by way of the signal.

While the present disclosure has been described in connection with a plurality of exemplary aspects, as illustrated in the various figures and discussed above, it is understood that other similar aspects can be used, or modifications and additions can be made to the described aspects for performing the same function of the present disclosure without deviating therefrom. For example, in various aspects of the disclosure, methods and compositions were described according to aspects of the presently disclosed subject matter. However, other equivalent methods or composition to these described aspects are also contemplated by the teachings herein. Therefore, the present disclosure should not be limited to any single aspect, but rather construed in breadth and scope in accordance with the appended claims.

Exemplary Use Cases

The following exemplary use cases describe examples of a typical user flow pattern. They are intended solely for explanatory purposes and not limitation.

Figure 4A:
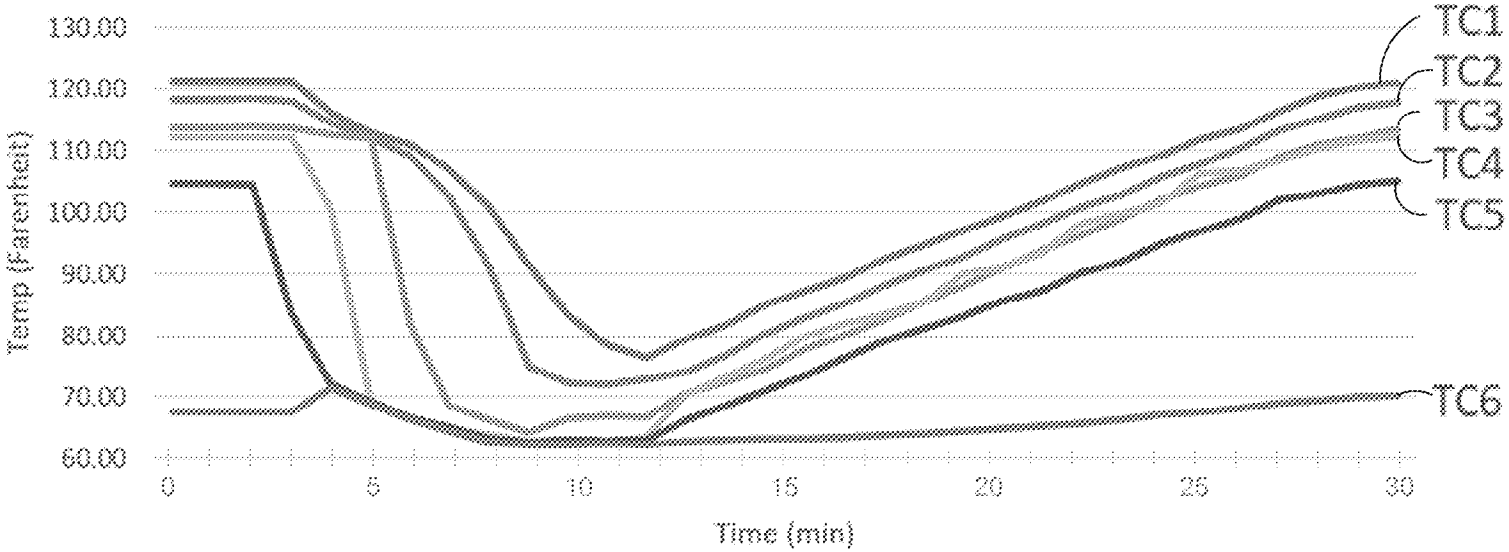
FIG. 4A illustrates a graph of temperature behavior inside a water tank in accordance with some examples of the present disclosure.

A tank can be analyzed using six temperature sensors spaced vertically throughout the tank. All BTU input rates can be performed for a variety of temperatures from 40 to 70 degrees Fahrenheit. A series of draws can be performed starting from 5 gallons and incrementing by 5 gallons (e.g., 10 gallons, 15 gallons, etc.) up to the capacity of the tank. For example, FIG. 4A illustrates a 45 gallon draw with an energy setpoint of 120 BTU and an inlet temperature of 59 degrees Fahrenheit.

Figure 4B:
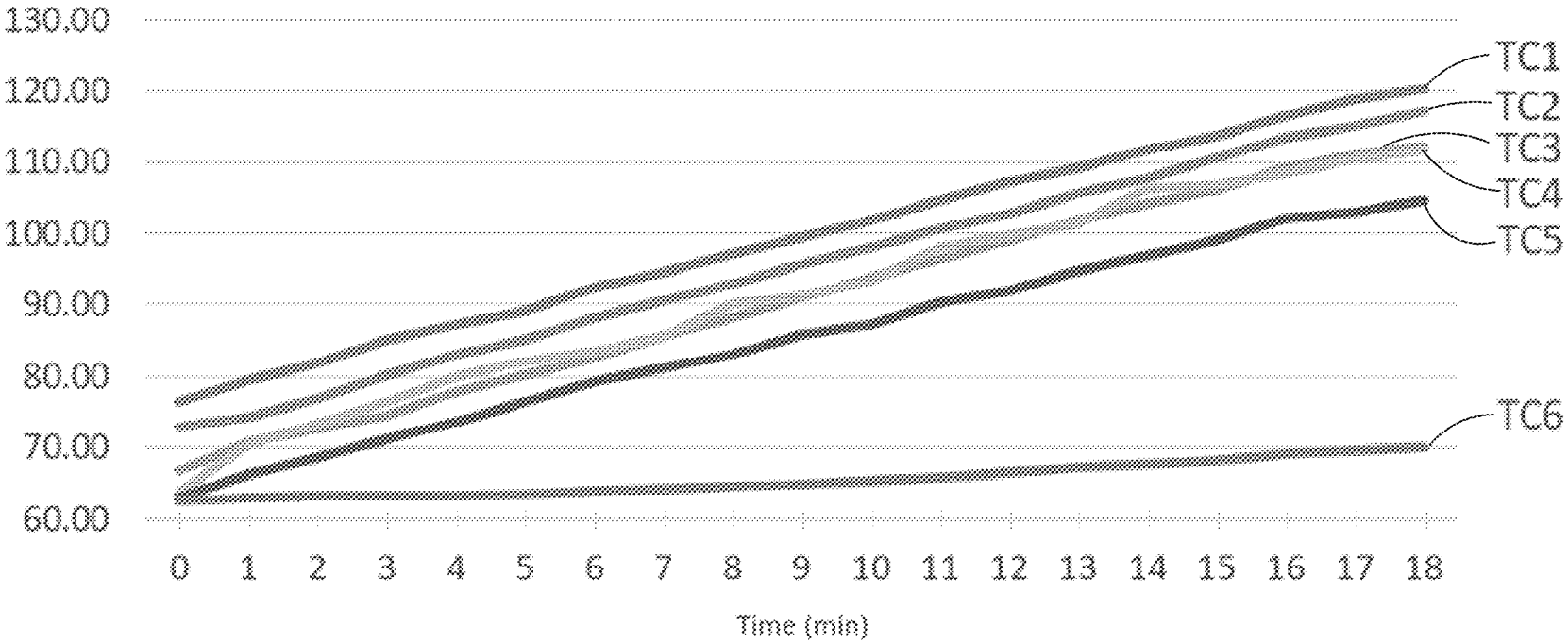
FIG. 4B illustrates another graph of temperature behavior inside a water tank in accordance with some examples of the present disclosure.

For all draws and combinations of BTU setpoint and inlet temperature, linear regression can be performed on the temperature response for each temperature sensors. The linear regression of the above example is shown in FIG. 4B. An example of the corresponding linear equations for a plurality of draws is shown below in Table I. The subsequent equations can be normalized for draw volume such that a flow meter is not required. The equations normalized for draw volume are shown below in Table II.

TABLE I

Linear equations for six temperature sensors under 10-gallon to 45-gallon draws

| 50 Gal | 50K BTU | 120 Set | 40 Inlet | | | |
|---|---|---|---|---|---|---|
| | TC1 | TC2 | TC3 | TC4 | TC5 | TC6 |
| 10G | 1.9744*x + 100.29 | 1.8359*x + 96.548 | 1.3404*x + 89.417 | 4.5083*x + 49.192 | 2.4068*x + 46.819 | 0.1036*x + 50.688 |
| 15G | 2.1726*x + 96.719 | 2.1031*x + 91.723 | 1.0341*x + 87.01 | 3.5604*x + 52.945 | 2.6127*x + 47.76 | 0.2321*x + 48.858 |
| 20G | 2.1106*x + 96.177 | 2.0528*x + 90.07 | 2.8448*x + 65.59 | 3.1003*x + 54.194 | 2.6376*x + 46.909 | 0.2539*x + 48.397 |
| 25G | 1.8326*x + 96.032 | 1.8515*x + 89.294 | 3.2017*x + 58.173 | 3.033*x + 56.121 | 2.7629*x + 47.953 | 0.3231*x + 49.352 |
| 30G | 1.7545*x + 95.098 | 1.8985*x + 87.146 | 3.0267*x + 59.27 | 2.9631*x + 58.741 | 2.7829*x + 49.045 | 0.3412*x + 49.183 |
| 35G | 1.8422*x + 87.252 | 2.1619*x + 78.498 | 2.87*x + 58.404 | 2.9412*x + 57.623 | 2.8159*x + 47.245 | 0.4265*x + 48.225 |
| 40G | 1.9528*x + 84.051 | 2.2608*x + 75.832 | 2.825*x + 59.318 | 2.8318*x + 58.339 | 2.7096*x + 48.888 | 0.4466*x + 48.605 |
| 45G | 2.1788*x + 74.386 | 2.3722*x + 67.744 | 2.6815*x + 56.642 | 2.7209*x + 55.513 | 2.6815*x + 46.835 | 0.4755*x + 48.234 |

TABLE II

Linear equations normalized by draw volume

| | TC1 | TC2 | TC3 | TC4 | TC5 |
|---|---|---|---|---|---|
| 120 Set | y = 2.022428x + 90.760603 | y = 2.094760x + 84.978917 | y = 2.502054x + 71.588292 | y = 2.846896x + 66.192931 | y = 2.377965x + 61.345736 |
| 140 Set | y = 1.878441x + 105.372917 | y = 1.998413x + 98.032708 | y = 2.536825x + 77.817083 | y = 2.914829x + 71.726125 | y = 2.315004x + 66.771083 |
| 160 Set | y = 1.779663x + 118.273583 | y = 1.919762x + 110.108375 | y = 2.222771x + 87.317625 | y = 2.995963x + 72.184583 | y = 2.331804x + 66.961000 |

The correction factor k can then be calculated and applied to the equations to account for the inlet temperature. An example generalized algorithm is shown in more detail in FIG. 5.

Figure 5:
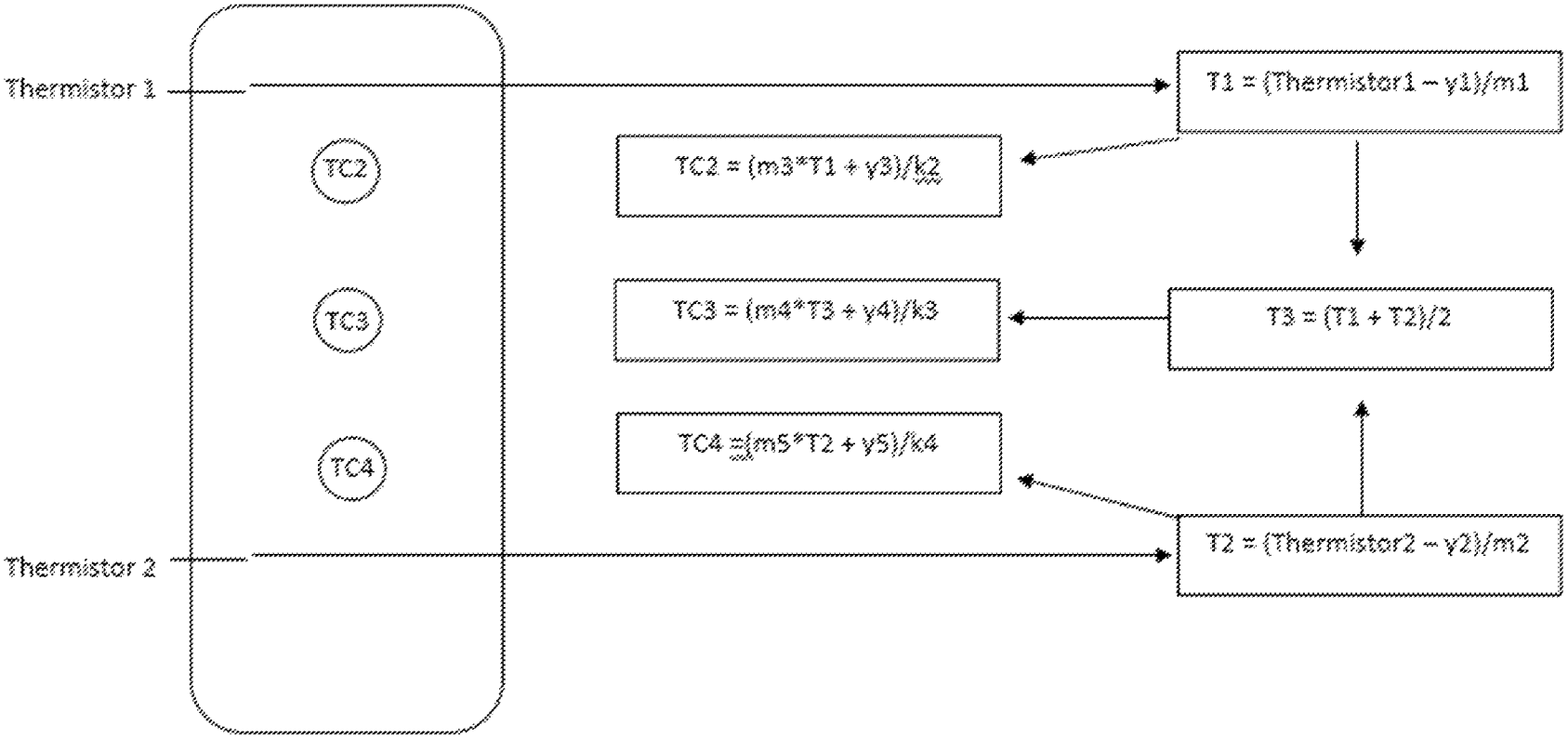
FIG. 5 illustrates a component diagram of a water heating system in accordance with some examples of the present disclosure.

As shown in FIG. 5, the time(t) can be solved for by using the temperature data and isolating the variable t and using the known variables of y, m, and Thermistor1 and/or Thermistor2 to solve for their respective time values. These time values can then be inserted into the equations for TC2 and TC4 respectively and an average of the two-time values can be inserted into TC3. Using a calculator, the system can be able to calculate the values that would be determined as a result of this method and compare them to raw data collected from testing.

The algorithms can then be used to determine the amount of hot water available in a tank. A user of the system may wish to take a warm shower. The user can check to ensure enough hot water is present for a hot shower. Using the algorithms, the system can determine that the tank does not have enough hot water. The system can then instruct the heating element to begin heating to create more hot water. A graphical display can be provided on the user device to generally illustrate the amount of available hot water along with an estimated time until the tank can create enough hot water for their shower.

What is claimed is:

1. A water heating system comprising:

a water heater comprising:

a tank;

an inlet line configured to receive unheated water and guide the unheated water to the tank;

an outlet line configured to guide heated water out of the tank;

a first temperature sensor disposed at a first location that is between a midline of the tank and a top end of the tank, the first temperature sensor being configured to measure a first temperature of water at the first location and output first temperature data indicative of the first temperature;

a second temperature sensor disposed at a second location that is between the midline of the tank and a bottom end of the tank, the second temperature sensor being configured to measure a second temperature of the water at the second location and output second temperature data indicative of the second temperature; and a controller having a processor, the controller communicably coupled to the first temperature sensor and the second temperature sensor and configured to determine water temperature characteristics of the water in the tank based on one or more algorithms, the first temperature data, and the second temperature data, wherein the processor is configured to:

execute the one or more algorithms to determine one or more calculated temperatures for water at one or more respective intermediate locations disposed between the first and second locations;

determine the water temperature characteristics based at least in part on the one or more calculated temperatures, the water temperature characteristics including an amount of heated water in the tank;

determine that a first amount of water is included in the tank at a first time;

cause to present, via a user interface, a graphical indication of the amount of heated water in the tank, the graphical indication including a first color indicating the first amount of water;

determine that a second amount of heated water is included in the tank at a second time; and cause to present, via the user interface, a second color indicating the second amount of heated water, the second color being different than the first color.

2. The system of claim 1, wherein the controller is configured to determine the water temperature characteristics without information indicative of a capacity of the tank, without information indicative of a flow rate of the heated water at the outlet line, or without information indicative of a flow rate of the unheated water at the inlet line.

3. The system of claim 1, wherein the water heater further comprises a heating system communicably coupled to the controller, the heating system being configured to provide heat to the unheated water, and wherein the controller controls operation of the heating system, the controller are configured to turn off the heating system when a temperature within the tank exceeds a maximum threshold value.

4. The system of claim 1, wherein the controller is configured to determine the water temperature characteristics substantially instantaneously upon receipt of the first and second temperature data, subsequent to the water heater outputting a quantity of heated water from the tank, or after a draw of heated water from the tank stops.

5. The system of claim 1, wherein the controller is configured to determine the water temperature characteristics based at least in part on a temperature set point value of the tank.

6. The system of claim 1, wherein each of the one or more intermediate locations are spaced substantially equidistantly between the first and second locations along a height of the tank.

7. The system of claim 1, wherein the one or more calculated temperatures comprise three calculated temperatures for water at three respective intermediate locations.

8. The water heating system of claim 1, wherein the graphical indication comprises an image of a tank and/or one or more zones or bands indicating the amount of heated water in the tank.

9. The water heating system of claim 8, wherein the processor is further configured to:

determine that a first amount of water is included in the tank at a first time;

cause to present, via the user interface, a first band;

determine that a second amount of water is included in the tank at a second time; and cause to present, via the user interface, the first band and a second band.

10. A controller for a water heater system, the controller comprising:

a processor; and memory having instructions stored thereon that, when executed by the processor, cause the controller to:

receive first water temperature data from a first temperature sensor and second water temperature data from a second temperature sensor, wherein the first temperature sensor is disposed at a first location in a tank of a water heater of the water heater system, the first location being between a midline of the tank and a top end of the tank, and the second temperature sensor is disposed at a second location in the tank that is between a midline of the tank and a bottom end of the tank; and determine, based at least in part on the first and second temperature data and one or more algorithms, a currently available amount of heated water currently stored in the tank by:

solving the one or more algorithms for one or more calculated temperatures at one or more respective intermediate locations disposed between the first location and the second location; and determining water temperature characteristics based at least in part on the one or more calculated temperature, the water temperature characteristics including an amount of heated water in the tank;

determine that a first amount of water is included in the tank at a first time;

cause to present, via a user interface, a graphical indication of the amount of heated water in the tank, the graphical indication including a first color indicating the first amount of water;

determine that a second amount of heated water is included in the tank at a second time; and cause to present, via the user interface, a second color indicating the second amount of heated water, the second color being different than the first color.

11. The controller of claim 10, wherein the instructions, when executed by the processor, further cause the system to:

receive a request to draw heated water from the tank for a task;

determine that the tank holds an insufficient amount of heated water for the task; and determine, based on the one or more algorithms, an amount of time until a sufficient amount of heated water in the tank will become available for the task.

12. The controller of claim 10, wherein the instructions, when executed by the processor, further cause the system to:

output instructions for the water heater to implement one or more corrective actions, the one or more corrective actions comprising one or more of: heating, by one or more heating elements, any water within the tank, and instructing one or more agitators disposed within the tank to agitate the water within the tank.

13. The controller of claim 10, wherein the instructions, when executed by the processor, further cause the system to:

generate the one or more algorithms based on one or more parameters of the tank.

14. The controller of claim 13, wherein generating the one or more algorithms comprises:

receiving data indicative of combinations of the one or more parameters of the tank; and performing a linear regression of the data to determine the one or more algorithms.

15. The water heating system of claim 10, wherein the graphical indication comprises an image of a tank and/or one or more zones or bands indicating the amount of heated water in the tank.

16. A water heating system comprising:

a water heater comprising:

a tank;

an inlet line configured to receive unheated water and guide the unheated water to the tank;

an outlet line configured to guide heated water out of the tank;

a first temperature sensor disposed at a first location that is between a midline of the tank and a top end of the tank, the first temperature sensor being configured to measure a first temperature of water proximate the first location and output first temperature data indicative of the first temperature;

a second temperature sensor disposed at a second location that is between the midline of the tank and a bottom end of the tank, the second temperature sensor being configured to measure a second temperature of the water proximate the second location and output second temperature data indicative of the second temperature; and a controller having a processor, the controller communicably coupled to the first temperature sensor and the second temperature sensor and configured to determine water temperature characteristics of the water in the tank based on one or more algorithms, the first temperature data, and the second temperature data, wherein the processor is configured to:

solve the one or more algorithms based on the first and second temperature data to determine one or more calculated temperatures for water at one or more respective intermediate points disposed between the first and second locations;

determine the water temperature characteristics based at least in part on the one or more calculated temperatures, the water temperature characteristics including an amount of heated water in the tank;

determine that a first amount of water is included in the tank at a first time;

cause to present, via a user interface, a graphical indication of the amount of heated water in the tank, the graphical indication including a first color indicating the first amount of water;

determine that a second amount of heated water is included in the tank at a second time; and cause to present, via the user interface, a second color indicating the second amount of heated water, the second color being different than the first color.

17. The system of claim 16, wherein generating the one or more algorithms comprises:

receiving data indicative of combinations of the one or more parameters of the tank; and performing a linear regression of the data to determine the one or more algorithms.

18. The system of claim 16, wherein the water heater further comprises a heating system communicably coupled to the controller, the heating system being configured to provide heat to water that is inside the tank, and wherein the controller controls operation of the heating system, the controller being configured to turn off the heating system when a temperature within the tank exceeds a maximum threshold value.

19. The system of claim 16, wherein each of the one or more intermediate points are spaced substantially equidistantly between the first and second locations along a height of the tank.

* * * * *